US006241578B1

(12) United States Patent
Togawa et al.

(10) Patent No.: US 6,241,578 B1
(45) Date of Patent: Jun. 5, 2001

(54) CARRIER DEVICE IN POLISHING APPARATUS AND METHOD FOR CONTROLLING CARRIER DEVICE

(75) Inventors: Tetsuji Togawa, Chigasaki; Nobuyuki Takada, Fujisawa, both of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/357,843

(22) Filed: Jul. 21, 1999

(30) Foreign Application Priority Data

Jul. 21, 1998 (JP) ..... 10-205137

(51) Int. Cl.[7] ..... B24B 9/00

(52) U.S. Cl. ..... 451/5; 451/8; 451/24; 451/41; 451/288

(58) Field of Search ..... 451/11, 24, 289, 451/290, 5, 8, 9, 10, 41, 288

(56) References Cited

U.S. PATENT DOCUMENTS

| | | | | |
|---|---|---|---|---|
| 5,498,196 | | 3/1996 | Karlsrud et al. . | |
| 5,868,896 | * | 2/1999 | Robinson et al. | 451/289 |
| 5,908,530 | * | 6/1999 | Hoshizaki et al. | 451/287 |
| 5,916,009 | * | 6/1999 | Izumi et al. | 451/5 |

FOREIGN PATENT DOCUMENTS

| | | |
|---|---|---|
| 63-295165 | 12/1988 | (JP) . |
| 6-270054 | 9/1994 | (JP) . |
| 10-58313 | 3/1998 | (JP) . |

* cited by examiner

*Primary Examiner*—M. Rachuba
(74) *Attorney, Agent, or Firm*—Wenderoth, Lind & Ponack, L.L.P.

(57) ABSTRACT

A carrier device is adapted for use in a polishing apparatus with a turntable having a polishing surface. The carrier device includes a carrier for carrying an article to be polished and a control device operatively associated with the carrier. The control device includes an actuator operable to cause the carrier to urge the article against the polishing surace of the turntable to polish the article, a sensor operatively associated with the actuator and operable to sense a pressure as applied to the article when the article is urged against the polishing surface of the turntable and a control unit operatively associated with the actuator and the sensor so as to monitor the pressure during a polishing operation. The control unit is operable to control operation of the actuator in response to the pressure as monitored so as to keep the pressure at a target level and halt the polishing operation when the pressure is deviated from a predetermined range over a predetermined period of time.

13 Claims, 5 Drawing Sheets

CARRIER DEVICE IN POLISHING APPARATUS AND METHOD FOR CONTROLLING CARRIER DEVICE

BACKGROUND OF THE INVENTION

The present invention relates to polishing apparatus for polishing a semiconductor wafer or other articles, and in particular, to a carrier device adapted for use in such polishing apparatus and designed to controllably carry an object with the object held in engagement with the polishing surface of a turntable during a polishing process.

FIG. 5 shows a typical semiconductor wafer polishing apparatus wherein a polishing process, commonly known as "chemical-mechanical planarization" (CMP), is carried out to finely polish a semiconductor wafer. The polishing apparatus generally includes a turntable 200, a wafer carrier device 210 and a polishing surface dressing device 220.

The turntable 200 is provided on its upper surface with a polishing pad made of polyurethane foam, artificial leather or the like or a fixed abrasive plate and is connected to a drive shaft 201. The drive shaft is in turn connected to a motor (not shown) so that the turntable 200 is turned around its center axis. The wafer carrier device 210 includes a wafer carrier 211 in the shape of a disc and a motor 212 for ratating the wafer carrier 211 around its center axis through a transmission with a drive shaft 215 connected to the wafer carrier. The wafer carrier 211 is fluidly connected to a vacuum source (not shown) through a pipe 217. The pipe is connected to the drive shaft to positively hold a semiconductor wafer against the bottom surface of the wafer carrier 211 by vacuum. The polishing surface dressing device 220 includes a dressing tool 221 and a motor 222 for rotating the dressing tool 221 around its center axis. The wafer carrier device 210 and the dressing device 220 are mounted on pivot shafts 231 and 241, respectively, so that the wafer carrier 211 and the dressing tool 221 are brought into and out of engagement with the polishing pad of the turntable 200. Further, the wafer carrier 211 and the dressing tool 221 are both moved in a vertical direction by actuators or air cylinders 252 and 272.

During operation, the wafer carrier holds a semiconductor wafer on its bottom surface and brings it into engagement with the polishing pad on the rotating turntable 200 while being rotated around its center axis. After a desired numberof wafers are successively subjected to the polishing operation, the wafer carrier 211 is pivoted and brought out of engagement with the turntable and the dressing device 220 is pivoted to bring the dressing tool 221 into contact with the polishing pad on the turntable for conducting a dressing operation with respect to the polishing pad.

In such a polishing apparatus, there is a possibility that a crack may be created in a wafer which is being polished. If the polishing operation is continued in such a condition, the crack may become bigger so that the wafer carrier and/or the turntable may be eventually damaged. Further, a pressure controller may malfunction, whereby an inappropriate pressure such as an excessive pressure or insufficient pressure may be imposed on a wafer.

SUMMARY OF THE INVENTION

Accordingly, it is an object of the present invention to provide a carrier device with a control device for positively detecting such an anomalous situation in a polishing operation to make it posible to take a necessary action to cope with the anomalous situation.

In accordance with this invention, there is provided a carrier device adapted for use in a polishing apparatus with a turntable having a polishign surface. The carrier device comprises a carrier for carrying an article to be polished and a control device operatively associated with the carrier. The control device includes an actuator operable to cause the carrier to urge the article against the polishing surface of the turntable to polish the article, a sensor operatively associated with the actuator and operable to sense a pressure as applied to the article when the article is urged against the polishing surface of the turntable and a control unit operatively associated with the actuator and the sensor to monitor the pressure during a polishing operation. The control uhit is operable to control operation of the actuator in response to the pressure as monitored so as to keep the pressure at a target level and halt the polishing operation when the pressure deviated from a predetermined range over a predetermined period of the time.

Specifically, the carrier device further comprises a casing for supporting the carrier, the sensor being disposed between the casing and the acutator so as to sense the pressure as a reactive force developed when the actuator causes the carrier to urge the article against the polishing surface of the turntable.

The control unit may be adapted to halt the polishing operation after the current polishing operation for the article is completed if the pressure exceeds a first threshold pressure level over a predetermined period of time, and to immediately halt the polishing operation if the pressure exceeds a second threshold pressure level over a predetermined period of time, the second threshold pressure level being greater than the first threshold pressure level.

Further, The control unit includes a memory for storing the target value, the first threshold pressure level, and the second threshold presure level.

Furthermore, the control unit may be adapted to halt the polishing operation if the pressure drops below a first threshold pressure level and thereafter exceeds a second threshold presure level, the target level being less than the second threshold pressure level and greater than the first threshold pressure level.

The present invention further provides a method for controlling a carrier deice in a polishing apparatus which has a turntable having a polishing surface, the carrier device comprising a carrier for carrying an article to be polished and an actuator operable to cause the carrier to press the article against the polishing surface of the turn table. The method includes monitoring a pressure as applied to the article while the article is urged against the polishing surface of the turntable, regulating the actuator in response to the pressure as monitored so as to keep the pressure at a target level, and halting a polishing operation when the pressure deviates from the predetermined range over a predetermined period of time.

In another method, if the pressure exceeds a first threshold pressure level over a predetermined period of time, a polishing operation is halted after the current polishing operation for the article is completed, and if the pressure exceeds a second threshold pressure level greater than the first threshold pressure level over a predetermined period of time, the current polishing operation is immediately halted.

In another method, if the pressure drops below a first threshold pressure level and thereafter exceeds a second threshold pressure level greater than the first threshold level, a polishing operation is immediately halted.

The above and other features and advantages of the present invention will become apparent from the following description and the appended claims taken in conjunction with the accompaning drawings.

DETAILED DESCRIPTION OF THE INVENTION

Figure 1:
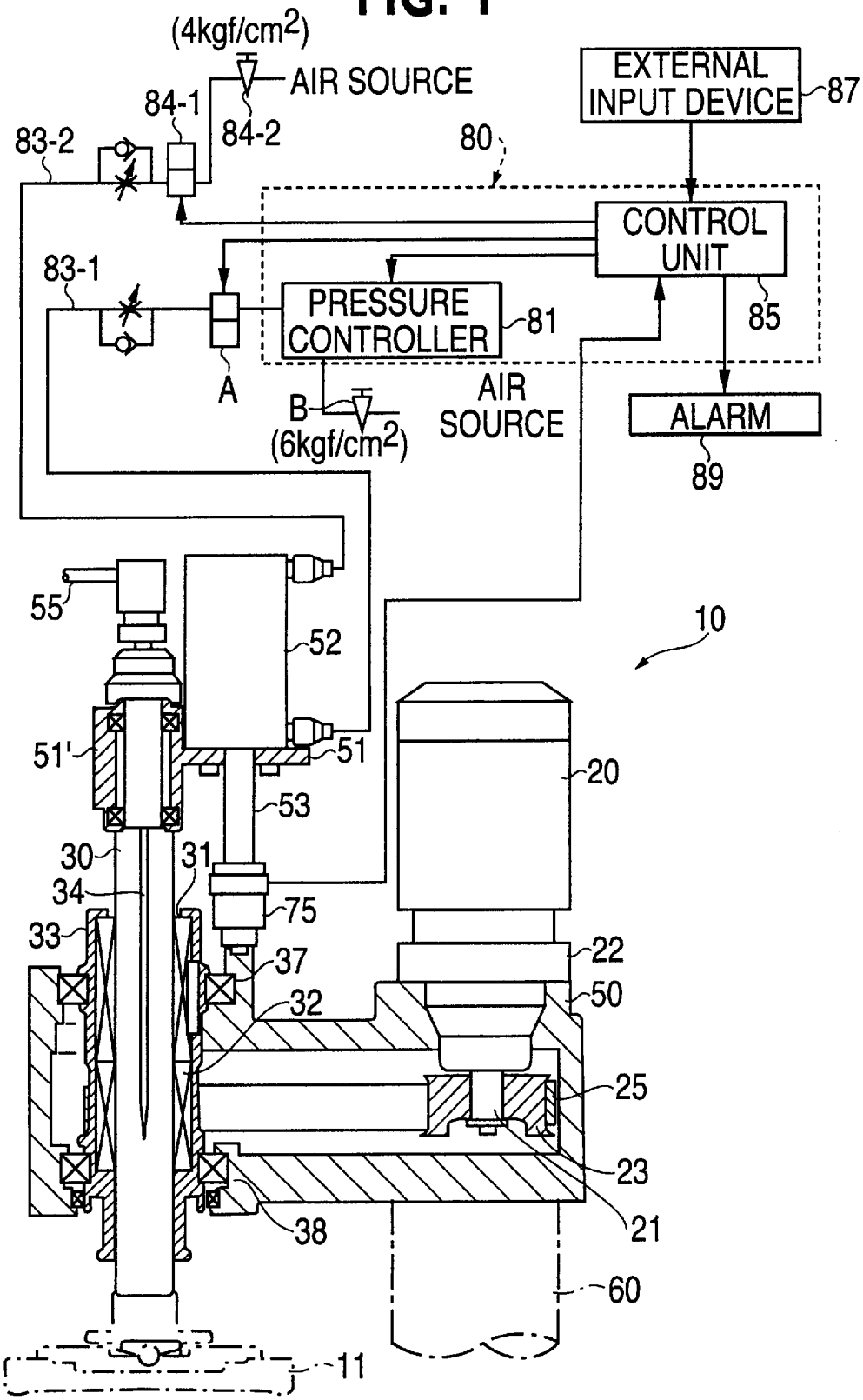
FIG. 1 is a schematic view of a polishing apparatus employing a control device in accordance with this invention.

FIG. 1 shows a wafer carrier device 10 in accordance with an embodiment of the present invention which is employed in a semiconductor wafer polishing apparatus. The wafer carrier device 10 includes a wafer carrier 11 in the shape of a disk, a carrier drive shaft 30 connected centrally to the upper side of the wafer carrier, a motor 20 mounted on casing 50 and drivingly connected to the carrier drive shaft 30, and an actuator or air cylinder 52 for moving vertically the carrier drive shaft 30 through the casing 50. The actuator 52 is mounted on the casing 50 and has a piston rod 53. A load cell or pressure sensor is disposed between the casing and the lower end of the piston rod. The bottom surface of thewafer carrier is adapted to hold a wafer. The actuator imposes a pressing force on the wafer carrier through the drive shaft to press the wafer against the polishing pad. As an important feature, the wafer carrier device includes a controller for controlling the pressing force.

The motor 20 is drivingly connected to a speed reducer 22 having an output shaft on which a pulley 23 is provided.

The carrier drive shaft 30 is hollow. The shaft is provided on its outer surface with a spline bushing 31 and a liner bushing 32 around which a sleeve 33 is mounted. The sleeve 33 is supported in the casing 50 by upper and lower bearings 37 and 38 so that the carrier drive shaft 30 is rotatable about its axis. An endless belt 25 is trained around the pulley 23 and the sleeve 33.

The spline bushing 31 is engaged with a spline groove 34 formed on the outer surface of the shaft 30 through a bearing (not shown) so that the spline bushing 31 and the carrier drive shaft 30 are rotated together by means of the endless belt 25 driven by the motor 20 while they are axially movable relative to each other. The linear bushing 32 rotatably supports the carrier drive shaft 30 with the drive shaft allowed to axially move relative to the linear bushing.

The wafer carrier 11 is fluidly communicated with a vacuum source (not shown) through the hollow carrier shaft 30 and a pipe 55 connected to the upper end of the hollow carrier drive shaft 30. This enables the wafer carrier to hold a semiconductor wafer against the bottom surface of the carrier by vacuum.

Figure 5:
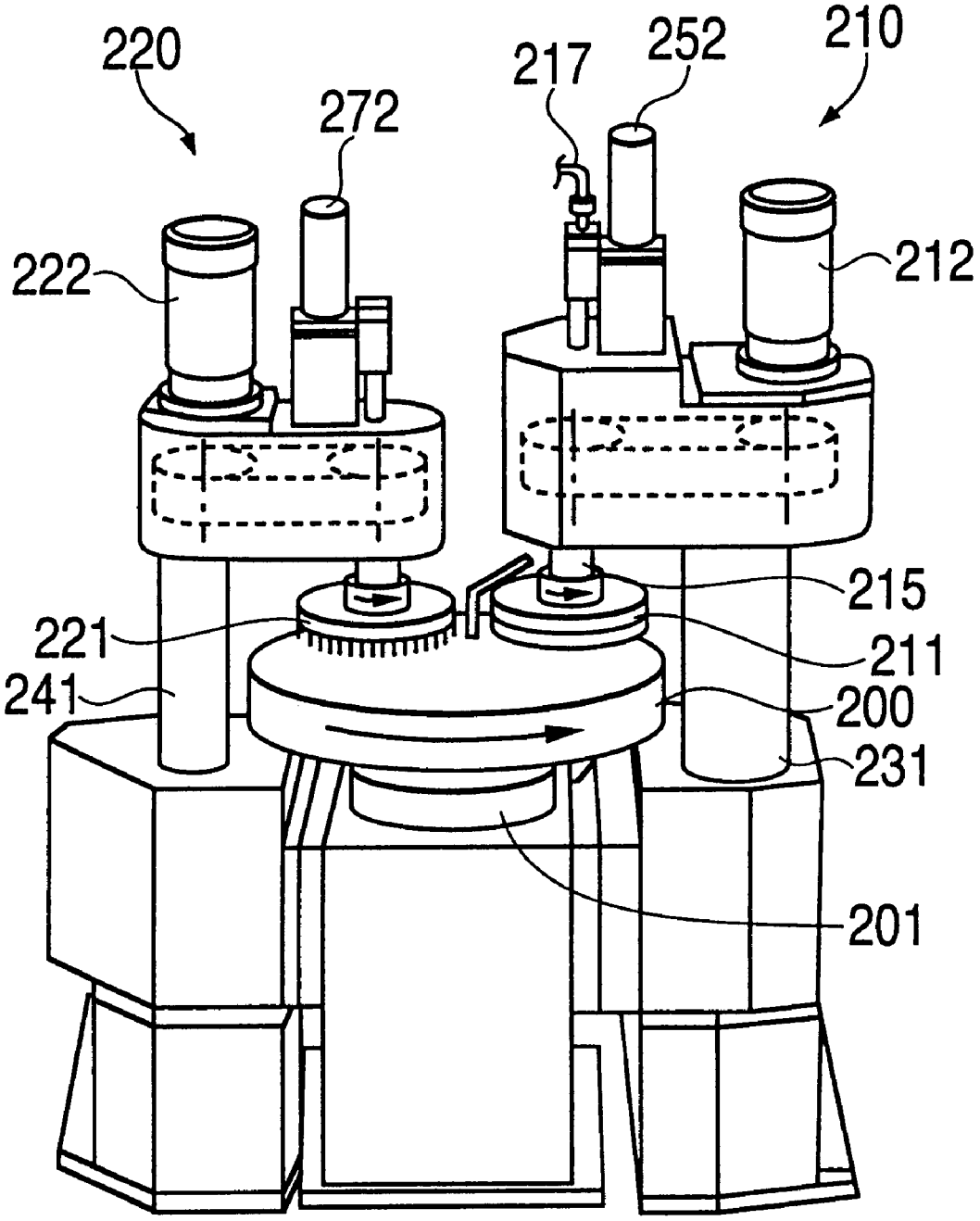
FIG. 5 (PRIOR ART)
FIG. 5 is a perspective view of a typical polishing apparatus.

The carrier drive shaft 30 is provided at its upper end with a bracket 51 having a cylindrical support sleeve 51' which is rotatably mounted on the upper end of the shaft. The bracket 51 is acially movable with the shaft. The bracket 51 supports the actuator or air cylinder device 52. The casing 50 is fixedly mounted on a pivotal shaft 60 corresponding to the pivotal shaft 231 shwon in FIG. 5.

The air cylinder 52 is fluidly connected to an air supply system through air conduits 83-1 and 83-2 which are fluidly communicated with lower and upper ends of the air cylinder 52. The air supply system is controlled by control 80.

The interior of the air cylinder 52 is divided into upper and lower chambers by a piston (not shown) provided at a top end of the piston rod 53. The air cylinder 52 is moved down when a pressurized air is introduced into the lower chamber through the conduit 83-1 and moved up when a pressurized air is introduced into the upper chamber in the air cylinder through the conduit 83-2.

The conduit 83-1 is fluidly connected to an air source (not shown) through is solenoid valve A having two positions, i.e., an air supply position and a vent position, a pressure controller 81 for controlling pressurized air supplied to the air cylinder 52, and a pressure relief valve B. The conduit 83-2 is fluidly connected to an air source (not shwon) through
a solenoid valve 84-1 having two positions, i.e., an air supply position and a vent position and a pressure reduction valve 84-2.

Figure 2:
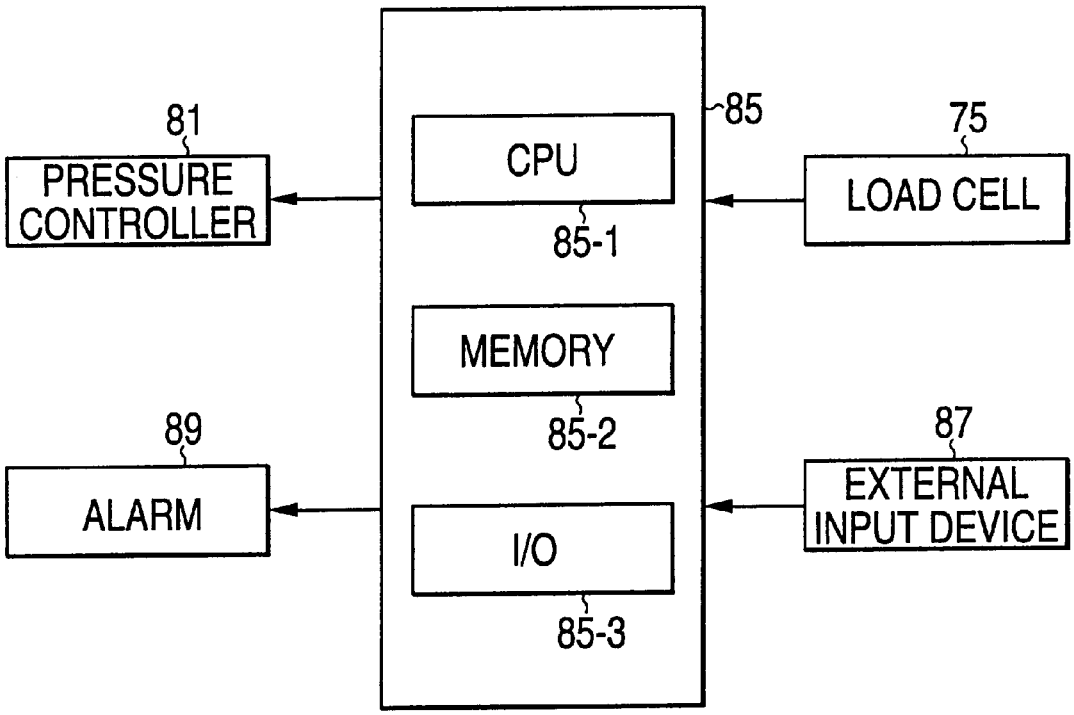
FIG. 2 is a schematic diagram showing a control unit employed in the control device shown in FIG. 1.

The control 80 includes a control unit 85 which, as shown in FIG. 2, comprises a CPU 85-1, a memory 85-2 including a ROM and a RAM and an input/output ports 85-3. The control unit 85 is adapted to receive signals representatie of loads sensed by load cell 75 and signals from an external input device 87 such as a key board and to output control signals to the pressure controller 81, the solenoid valves A and 84-1, an alarm 89 and other elements which are to be controlled by the control unit.

In a polishing operation, the wafer carrier device is first pivoted about the pivot shaft 60 to move the wafer carrier 11 to a position outside the truntable, and a first wafer is placed on the bottom surface of the carrier and held thereon by means of a vacuum force applied to the carrier. Then, the wafer carrier device is pivoted about pivot shaft 60 to bring the wafer carrier 11 to a predetermined position above the turntable. Thereafter, the solenoid valve 84-1 is moved to its vent position to open the conduit 83-2 to the atmosphere and the solenoid valve A is moved to its air supply position to supply a pressurized air, the pressure of which is controlled by the pressure controller 81, into the lower chamber in the air cylinder 52, whereby the cylinder 52 is lowered relative to the piston-rod 53 (thus, the casing 50) so that the carrier drive shaft 30 and the wafer carrier 11 are lowered thereby urging the wafer against the polishing surace of the turning turntable for polishing the first wafer. During the polishing operation, the turntable and the wafer carrier are rotated about their own center axes. When the first wafer has been completely polished, the wafer carrier device 10 is moved up and pivoted outside the turntable while halting the rotation of the wafer carrier. Thereafter, the polished first wafer is replaced by a second or new wafer. The second and following wafers are successively polished in the same way.

During the polishing, a pressure under which the wafer is urged against the polishing pad on the turntable is kept substantially constant by controlling the pressure controller 81 by means of the control unit 85. This control is herein referred to as "pressure control".

There is a possibility that a crack may occur in a wafer during the polishing operation, or the pressure controller 81 may malfunction. In this embodiment, the control unit 85 determines whether such an anomalous or critical situation has occurred on the basis of a change in a pressure for urging a wafer aainst the polishing pad so that an appropriate action is taken as is necessary. This is herein referred as "failure detection/control".

Figure 3:
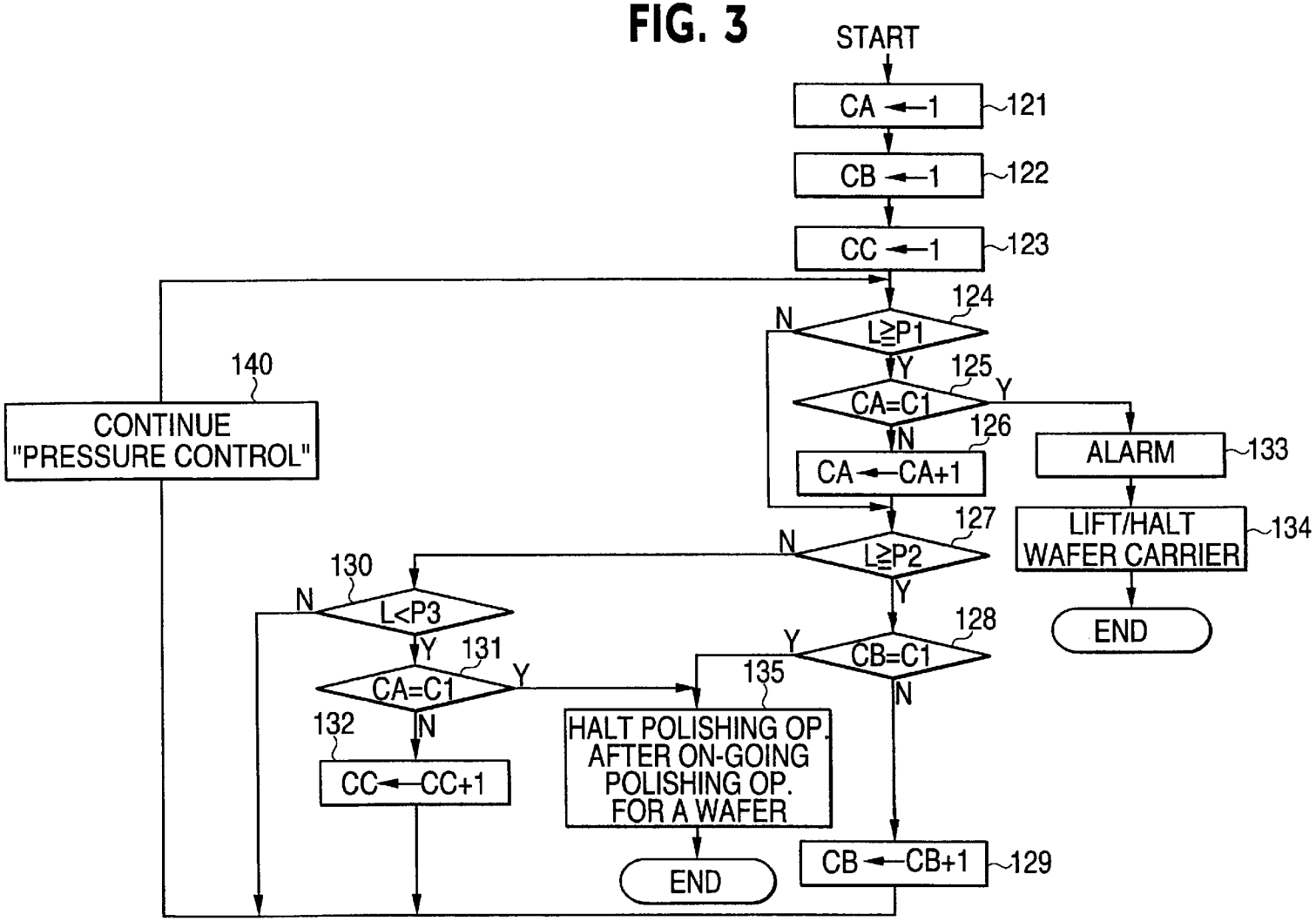
FIG. 3 is a flow diagram representative of a computer program executed for performing functions of the control unit.

FIG. 3 shows a flow diagram representative of a computer program executed by the control unit 85 for carrying out the "pressure control" and the "failure detection/control" in this embodiment during the above-stated polishing operation.

Before starting the polishing operation and thus the control operation by the control unit 85, as operator inputs through the outside input device 87 various instructions or the information on various conditions with respect to the "pressure control" and the "failure detection/control" and stores them into the RAM of the memory 85-2. The instructions include a desired value L1 of magnitude of a pressure L at which a wafer carried by the wafer carrier 11 should be urged against the polishing pad on the turntable, first and second upper threshold values P2 and P1 and a lower threshold value P3 of the pressure L. The relationship between these values if P1>P2>L1>P3 and it is set that when a pressure or load L sensed by the load cell 75 falls within a range of from P3 to P2, the sensed pressure L is in a normal condition. Those values may be set in accordance with conditions of a polishing operation to be performed. Further, the instructions include C1 which is a reference number to be compared with CA, CB, CC which will be explained herein below.

Figure 4:
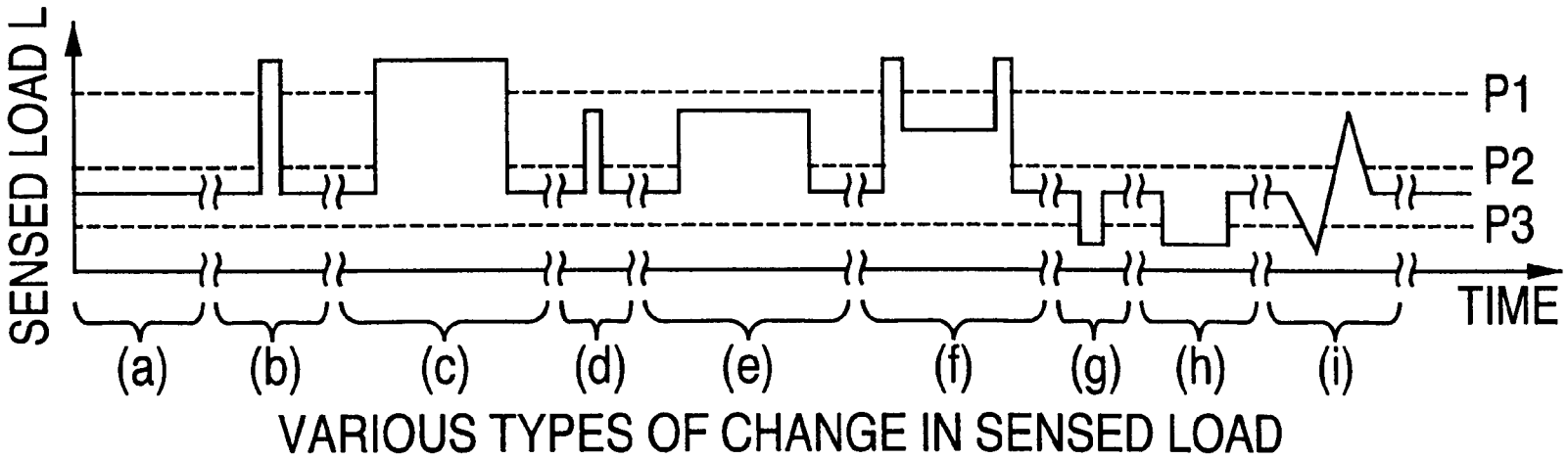
FIG. 4 is a diagram showing various types of change in a presure under which an article to be polished is urged against a polishing surface in the polishing apparatus.

Referring to FIGS. 3 and 4, the control unit 85 will be explained. FIG. 4 shows various types of change (a)–(i) in magnitude of value of the force or pressure L sensed by the load cell 75. As shown, in the flow chart of FIG. 3, before entering into the main routine of the program, CA, CB and CC are initialized to be "1", steps 121, 122 and 123, in addition to initialization for setting timers, registers and so on which are not designated in the drawings.

Normal Polishing Operation:

Change (a):

This change shows that a polishing operation performed by the polishing apparatus is in a normal condition so that a magnitude of the value of the sensed load L is kept within a range between P2 and P3.

Accordingly, in FIG. 3, a process consisting of steps 124, 127, 130 and 140 is repeated, whereby the "pressure control" is executed all the time during the normal polishing operation to keep the force L to be L1.

Changes (b), (d) and (g):

Even if the force L becomes, as shown in (b), (d) and (g) in FIG. 4, larger than P1 or P2 or smaller than P3 for a very short time, if the force thereafter returns to a normal level in the range P2–P3, such a change may be an error in measurement caused by, for instance, some minor noise and, thus, in this embodiment, the polishing operation is continued under the "pressure control".

In the case of (b) in FIG. 4, when the sensed load L is first determined to be larger than P1 <step 124>, CA (i.e., a number of affirmative (i.e., Yes) determinations in step 124 which has been successively performed) is compared with a predetermined number C1. Since CA is initially set to be "1", CA is incremented by "1" <126>. Thereafter, the sensed load L is determined to be larger than the second upper threshold P2 <step 127> and, then, CB (i.e., a number of affirmative (i.e., Yes) determinations in step 127 which has been successively performed) is compared with C1 <128>. Since CB is initially set to be "1", CB is incremented by "1" <129>. The process consequently goes to step 140 where the "pressure control" is continued and then returns to step 124 to repeatedly execute the same process, whereby CA and CB are both incremented for each repeated execution of the program. In the case of the change (b), since it is assumed that the magnitude value ofthe sensed load L returns to a normal level between P2 and P3 before either CA or CB becomes equal to C1, the program returns to the main loop which was explained above in connection with the change (a) in FIG. 4.

In the change (d), a process of the successive steps 124, 127, 128, 129 and 140 is repeated whereby the polishing operation by the polishing apparatus is continued under the "pressure control" executed in step 140. Before CB is incremented to be equal to C1, the sensed load L returns in a normal condition in which the value of the load is within a range of P2–P3, whereby the process executed by the control unit 85 returns to the main loop which was explained above in connection with the change (a) in FIG. 4.

In the change (g), when the value of magnitude of the sensed load decreased below P3 is sensed, the process consisting of the successive steps 124, 127, 130, 131, 132 and 140 is repeated, whereby the polishing operation is continued under the "pressure control". Before CC (i.e., a number of affirmative (i.e., Yes) determinations in step 130 which have been successively performed) eventually becomes equal to C1, the sensed load L falls with the range between P2 and P3 and then the process returns to the main loop as stated above.

Polishing Operation under Anomalous Situation:

Changes (c), (e), (f) and (h) show that anomalous situations, for instance, a situation wherein a crack is formed in a wafer or the air cylinder deivce 52 malfunctions, have occurred, so that the value of magnitude of a pressure sensed by the load cell 75 goes outside of the range P2–P3 and is maintained over a predetermined period.

Change (c):

In this change, the sensed load L increases over P1 and continues over a predetermined time period and, consequently, it is necessary to stop the polishing operation immediately.

With reference to FIG. 3, in this case, a process consisting of a series of the steps 124, 125, 126, 127, 128, 129 and 140 is repeated a number of times. Although the process goes through step 140, the value of magnitude of the sensed load remains above P1 for a predetermined time so that CA is finally incremented to be equal to C1, and then the process proceeds to the step 133 and step 134 whereby an alarm is given and simultaneously the wafer carrier 11 is lifted up and the rotation of the wafer carrier is stopped.

Change (e):

The change shows that an anomalous situation which is not so critical such as, for instance, one in which [a creation of ] a crack in a wafer has occurred so that a sensed load L has increased to have a value of magnitude within the range P2–P1 and been maintained at such a value over a predetermined time period. In this embodiment, the polishing operation is not stopped instantly. Instead, after finalization of the polishing operation with respect to a wafer being subjected to the poishing operation, the wafer carrier is lifted away from the turntable and then the rotation of the wafer carrier is halted for a while to enable an operator to check the apparatus and, if necessary, make some repairs before apolishing operation for a next new wafer is started.

In this case, a process consisting of a series of the steps 124, 125, 126, 127, 128, 129 and 140 is repeated a number of times and step 128 finally determines CB=C1; then the process proceeds to the step 135 which executes a program for lifting the wafer carrier and, then, stopping the rotation of the wafer after completion of the polishing of the wafer which has been subjected to the polishing operation.

Change (f):

In this change, although the value of magnitude of a sensed load L increases over P1 for very short time periods, it generally remains within the range P2–P1. In this embodiment, this change is supposed to show a situation which is anomalous but not so critical as, for instance, the formation of a crack in a wafer and, thus, the current poishing operation is continued until it is finalized and, thereafter, the operation of the wafer carrier device is halted.

In this case, a process consisting of a series of the steps 124, 125, 126, 127, 128, 129 and 140 and a process consisting of a series of the steps 124, 127, 128, 129 and 140 are alternatively executed, whereby CB is incremented for each execution of those process and eventually, in the step 128, is determined to be equal to C1 so that the process proceeds to the step 135 which executes a program for halting the operation of the wafer carrier device after the current polishing operation is completed.

Change (h):

This change shows that some trouble has occurred in the pressure controller 81 which causes an anomalous decrease in the force for urging a wafer supported by the wafer carrier 11 against the polishing pad on the turntable so that the value of magnitude of a load sensed by the load cell 75 decreases below P3 for a long time over a predetermined time. In this embodiment, when such a change occurs, the current polishing operation for a wafer is continued until it is finalized and then the operation of the wafer carrier device is halted to enable an operator to check the apparatus for example by removing the polished wafer from the wafer carrier and, if necessary, repairing the apparatus.

With reference to FIG. 3, the process consisting of the steps 124, 127, 130–132 and 140 is repeated so that CC is incremented by "1" for each repeated processes and finally CC becomes equal to C1 whereby the process eventually proceeds to the step 135.

Change (i):

In this change, the value of magnitude of a load sensed by theload cell 75 first decreases below P3 and then increases above P2 and finally returns to normal. This change demonstrates that a wafer which was subjected to a polishing operation has separated from the wafer carrier 11. Namely, the decrease in the value L to a value below P3 demonstrates that the wafer has been thrown away from the wafer carrier 11 so that the wafer carrier has lost an object to press against the polishing pad on the turntable thereby causing a rapid decrease in the value L. The following increase in the value L to a value above P2 demonstrates that the wafer carrier 11 which has lost the wafer was abruptly pressed against the polishing pad on the turntable by the air cylinder 52. The following return of the value L to a normal level, i.e., P2>L>P3 shows that the "pressure control" is continued in step 140 thereby lowering the force for pressing the wafer carrier toward the polishing pad by means of the air cylinder 52.

In this embodiment, a wave showing a change in the value L such as that designated by (i) is pre-stored in the memory 85-2 of the control unit 85 and, when the control unit 85 detects an occurrenceof such a wave-like change in the value L, it determines that a wafer which was held by the wafer carrier has separated from the carrier and the wafer carrier should be lifted up immediately.

Although in FIG. 1 there is shown load cell 75 as a sensor for sensing a pressure under which the wafer carrier is urged against he polishing pad on the turntable, such a sensor is not limited to the load cell 75. However, it is preferable to position such a sensor between the actuator or air cylinder 52 and the casing 50 so as to enable the sensor to sense a force which is actually imposed on the wafer carrier. This arrangement also makes it possible for the sensor to sense the force precisely without any delay so that the control unit can appropraitely control the wafer carrier in response to any anomalous situations which, as stated above, may occur during a polishing operation. Further, since in the embodiment described above the load cell 75 is fastened between the tip end of the piston-rod 53 and the casing 50, the fastening of the load cell can be effected easily.

Further, an actuator for actuating the wafer carrier 11 is not limited to theair cylinder device 52 as shown in FIG. 1 and may be of various types. Furthermore, although, in the flow chart shown in FIG. 3, the reference number for CA, CB, and CC is set to be the same, i.e., C1, different reerence numbers may be assigned for CA, CB and CC.

In the embodiment of this invention, an anomalous situation which may occur in a wafer carrier device during a polishing operation is detected by means of the load cell 75 which is provided for sensing a pressure under which a wafer carrier by the wafer carrier should be urged against the polishing suface of the turntable mainly in order to control the actuator 52 thereby maintaining the pressure at a desired value. This means that it is not necessary to add another particular sensor for detecting such an anomalous situation and further makes it possible for the control unit to appropriately control the wafer carrier in response to any anomalous situations without delay. Further, in this embodiment, the control unit 85 is adapted to be able to take actions suitable for various types of change in magnitude of values of a pressure imposed on a wafer so that appropriate control of the wafer carrier device can be attained.

While the invention is susceptible to various modifications and alternative forms, specific embodiments thereof have been shown by way of example and were herein described in detail. It should be understood, however, that it is not intended to limit the invention to the particular forms disclosed, but on the contrary, the intention is to cover all modifications, equivalents and alternatives falling within the spirit and scope of the invention as defined by the appended claims.

What is claimed is:

1. A carrier device adapated for use in a polishing apparatus with a turntable having a polishing surface, said carrier device comprising:

a carrier for carrying an article to be polished; and a control device operatively associated with said carrier and including:

an actuator operable to cause said carrier to urge the article against the polishing surface of the turntable to polish the article;

a sensor operatively associated with said actuator and operable to sense a pressure applied to the article when the article is urged against the polishing surface of the turntable by said actuator; and a control unit operatively associated with said actuator and said sensor to monitor the pressure during a polishing operation, said control unit being operableto control operation of said actuator in response to the pressure as monitored so as to keep the presurre at a target level and to halt the polishing operation when the pressure deviates from a predetermined range over a predetermined period of time.

2. A carrier device as set forth in claim 1, further comprising a casing for supporting said carrier, said sensor being disposed between said casing and said actuator so as to sense the pressure as a reactive force developed when said actuator causes said carrier to urge the article against the polishing surface of the turntable.

3. A carrier device adapted for use in a polishing apparatus with a turntable having a polishing surface, said carrier device comprising:

a carrier for carrying an article to be polished; and a control device operatively associated with said carrier and including:

an actuator operable to cause said carrier to urge the article against the polishing surface of the turntable;

a sensor operatively associated with said actuator and operable to sense a pressure applied when the article is urged against the polishing surface of the turntable by said actuator; and a control unit operatively associated with said actuator and said sensor to monitor the pressure during a polishing operation, said control unit being operable to control operation of said actuator in response to the pressure as monitored so as to keep the pressure at a target level, to halt the polishing operation after a current polishing operation for the article is completed if the pressure exceeds a first threshold pressure level over a predetermined period of time, and to immediately halt the polishing operation if the pressure exceeds a second threshold pressure level over a predetermined period of time, said second threshold pressure level being grater than said first threshold pressure level.

4. A carrier device as set forth in claim 3, wherein said control unit includes a memory for storing the target level, the first threshold presure level, and the second threshold pressure level.

5. A carrier device as det forth in claim 3, further comprising a casing for supporting said carrier, said sensor being disposed between said casing and said actuator so as to sense the pressure as a reactive force developed when said actuator causes said carrier to urge the article against the polishing surface of the turntable.

6. A carrier device adapate for use in a polishing apparatus with a turntable having a polishing surface, said carrier device comprising:

a carrier for carrying an article to be polished; and a control device operatively associated with said carrier and including:

an actuator operable to cause said carrier to urge the article against the polishing aurface of the turntable;

a sensor operatively associated with said actuator and operable to sense a pressure applied when the article is urged against the polishing surface of the turntable by said actuator; and a control unit operatively associated with said actuator and said sensor so as to monitor the pressure during a polishing operation, said control unit being operable to control operation of said actuator in response to the pressure as monitored so as to keep the pressure at a target level and to halt the polishing operation if the pressure drops below a first threshold pressure level and thereafter exceeds a second threshold pressure level, said target level being less than said second threshold pressure level and greater than said first threshold pressure level.

7. A carrier device as set forth in claim 6, further comprising a casing for supporting said carrier, said sensor being disposed between said casing and said actuator so as to sense the pressure as a reactive force developed when said actuator causes said carrier to urge the article against the polishing surface of the turntable.

8. A method for controlling a carrier device in a polishing apparatus which has a turntable having a polishing surface, said carrier device comprising a carrier for carrying an article to be polished and an actuator operable to cause said carrier to press the article against the polishing surface of the turntable, said method including:

monitoring a pressure applied to the article while the article is urged against the polishing surface of the turntable by said actuator, regulating said actuator in response to the pressure as monitored so as to keep the pressure at a target level, and halting an operation of said carrier device for performing a polishing operation when the pressure is deviated from said predetermined range target level over a predetermined period of time.

9. A method as set forth in claim 8, wherein said monitoring comprises sensing the pressure by a sensor disposed between said actuator and a casing supporting said carrier, whereby said pressure is sensed as a reactive force developed when said actuator causes said carrier to urge the article against the polishing surface of the turntable.

10. A method for controlling a carrier device of a polishing apparatus which has a turntable having a polishing surface, said carrier device comprising a carrier for carrying an article to be polished and an actuator operable to cause said carrier urge the article against the polishing surface of the turntable, said method including:

monitoring a pressure applied to the article while the article is urged against the polishing surface of the turntable by said actuator, regulating said actuator in response to the pressure as monitored so as to keep the pressure at a target level, and halting an operation of said carrier device for performing a polishing operation after a current polishing operation for the article is completed if the pressure exceeds a first threshold pressure level over a predetermined period of time, and to immediately halt the current polishing operation if the pressure exceeds a second threshold pressure level over a predetermined period of time, said second threshold pressure level being greater than said first threshold pressure level.

11. A method as set forth in claim 10, wherein said monitoring comprises sensing the pressure by a sensor disposed between said actuator and a casing supporting said carrier, whereby said pressure is sensed as a reactive force developed when said actuator causes said carrier to urge the article against the polishing surface of the turntable.

12. A method for controlling a carrier device of a polishing apparatus which has a turntable having a polishing surace, said carrier device comprising a carrier for carrying an article to be polished and an actuator operable to cause said carrier urge the article against the polishing surface of the turntable, said method including:

monitoring a pressure applied to the article while the article is urged against the polishing surface of the turntable by said actuator, regulating said actuator in response to the pressure as monitored so as to keep the pressure at a target level, and halting an operation of said carrier device for performing a polishing operation if the pressure drops below a first threshold pressure level and thereafter exceeds a second threshold pressure level, said target level being less than said second threshold pressure level and greater than said first threshold pressure level.

13. A method as set forth in claim 12, wherein said monitoring comprises sensing the pressure by a sensor disposed between said actuator and a casing supporting said carrier, whereby said pressure is sensed as a reactive force developed when said actuator causes said carrier to urge the article against the poishing surface of the turntable.

* * * * *